US005448274A

United States Patent [19]

Hirabayashi et al.

[11] Patent Number: 5,448,274

[45] Date of Patent: Sep. 5, 1995

[54] INK JET RECORDING APPARATUS AND CARRIAGE MECHANISM THEREFOR

[75] Inventors: Hiromitsu Hirabayashi; Tsuneki Inuzuka; Yoji Ara, all of Yokohama; Naoji Otsuka, Kawasaki; Kentaro Yano; Kiichiro Takahashi, both of Yokohama; Osamu Iwasaki, Tokyo, all of Japan

[73] Assignee: Canon Kabushiki Kaisha, Tokyo, Japan

[21] Appl. No.: 372,831

[22] Filed: Jan. 15, 1995

Related U.S. Application Data

[63] Continuation of Ser. No. 986,248, Dec. 7, 1992, abandoned.

[30] Foreign Application Priority Data

Dec. 11, 1991 [JP] Japan ..... 3-327560
Dec. 11, 1991 [JP] Japan ..... 3-351045

[51] Int. Cl.[6] ..... B41J 2/175
[52] U.S. Cl. ..... 347/86; 347/50
[58] Field of Search ..... 347/49, 50, 86, 87

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,419,677 | 12/1983 | Kasugayama et al. | 347/87 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,633,274 | 12/1986 | Matsuda | 347/50 |
| 4,635,080 | 1/1987 | Watanabe | 347/50 |
| 4,723,129 | 2/1988 | Endo et al. | 347/56 |
| 4,740,796 | 4/1988 | Endo et al. | 347/56 |
| 4,872,026 | 10/1989 | Rasmussen et al. | 347/56 |
| 4,878,069 | 10/1989 | Kiyohara | 347/86 |
| 4,990,938 | 2/1991 | Brandon et al. | 347/37 |
| 5,162,818 | 11/1992 | Karita et al. | 347/50 |

FOREIGN PATENT DOCUMENTS

| | | | |
|---|---|---|---|
| 0376719 | 7/1990 | European Pat. Off. . | |
| 0379151 | 7/1990 | European Pat. Off. . | |
| 260894 | 10/1988 | Germany | 347/86 |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 60-204323 | 10/1985 | Japan . | |
| 60-204342 | 10/1985 | Japan . | |
| 60-204343 | 10/1985 | Japan . | |
| 63-3958 | 1/1988 | Japan | 346/140 R |
| 2039945 | 2/1990 | Japan . | |

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

An ink jet recording apparatus for ejecting ink to effect recording on a recording material includes a carriage movable in a direction different from a direction in which the recording material is fed; and a pressing mechanism for pressing an end of an ink container for containing ink to be supplied to an ink jet recording head, wherein the pressing mechanism is effective to mount on the carriage the ink container and the ink jet recording head which are connected with each other by a connecting mechanism.

9 Claims, 12 Drawing Sheets

INK JET RECORDING APPARATUS AND CARRIAGE MECHANISM THEREFOR

This application is a continuation of U.S. application Ser. No. 07/986,248 filed Dec. 7, 1992, now abandoned.

FIELD OF THE INVENTION AND RELATED ART

Most of conventional ink jet recording apparatuses comprise a recording head which is substantially permanently usable, and an ink cartridge which is exchangeable to supply ink to the recording head. However, it is difficult to completely eliminate unexpected malfunction due to nozzle clogging or the like or the malfunction due to deterioration of ejection elements in long term use, and therefore, such a recording head is not completely free from problem in terms of reliability. This necessitates particularly maintenance service system for maintaining recording performance. From such a reliability standpoint, an exchangeable recording head cartridge having integral ink container and recording head, has been put into practice. With such an apparatus, the recording head subject to malfunction is periodically exchanged, depending on the predetermined ink consumption.

However, the exchangeable type recording head cartridge involves a problem that the ink capacity is more or less limited because of the size and weight of the cartridge and also because of the necessity for maintaining the reliability, with the result of increase of the running cost. In addition, when the ink is used up, the head cartridge has to be exchanged even if the recording head is still usable. This should be considered from a conversation standpoint.

SUMMARY OF THE INVENTION

Accordingly, it is a principal object of the present invention to provide an ink jet recording apparatus in which the recording head and the ink container are respectively exchangeable so that the advantages of the exchangeable type are enjoyed and so that the running cost problem and the earth environment problem are decreased.

It is another object of the present invention to provide an ink jet recording apparatus in which the ink container and the recording head are made integral on a carriage therefor to permit efficient ink supply to the recording head.

It is a further object of the present invention to provide an ink jet recording apparatus in which upon mounting the ink container and the recording head on the carriage, the connection between the ink container and the recording head and the connection between the recording head and the carriage are assured, and in addition, the exchange of the ink container and the recording head is made easier.

It is a yet further object of the present invention to provide an ink jet recording apparatus in which contamination of the apparatus, recording material or operator's hand due to leakage of the ink from the connecting part between the ink container and the recording head, and in addition, the ink container and the recording head are separably-exchangeable.

According to an aspect of the present invention, there is provided an ink jet recording apparatus for ejecting ink to effect recording on a recording material, comprising: a carriage movable in a direction different from a direction in which the recording material is fed; pressing mechanism for pressing an end of an ink container for containing ink to be supplied to an ink jet recording head, wherein said pressing mechanism is effective to mount on said carriage the ink container and the ink jet recording head which are connected with each other by a connecting mechanism.

According to another aspect of the present invention, there is provided a carriage mechanism for movement in a direction different from a feeding direction of a recording material, comprising: a portion for carrying an ink jet recording head; a pressing mechanism for pressing an end portion of an ink container for containing ink to be supplied to the ink jet recording head, wherein said pressing mechanism is effective to mount on said carriage the ink container and the ink jet recording head which are connected by a connecting mechanism.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Referring to the accompanying drawings, the embodiments of the present invention will be described.

Figure 1:
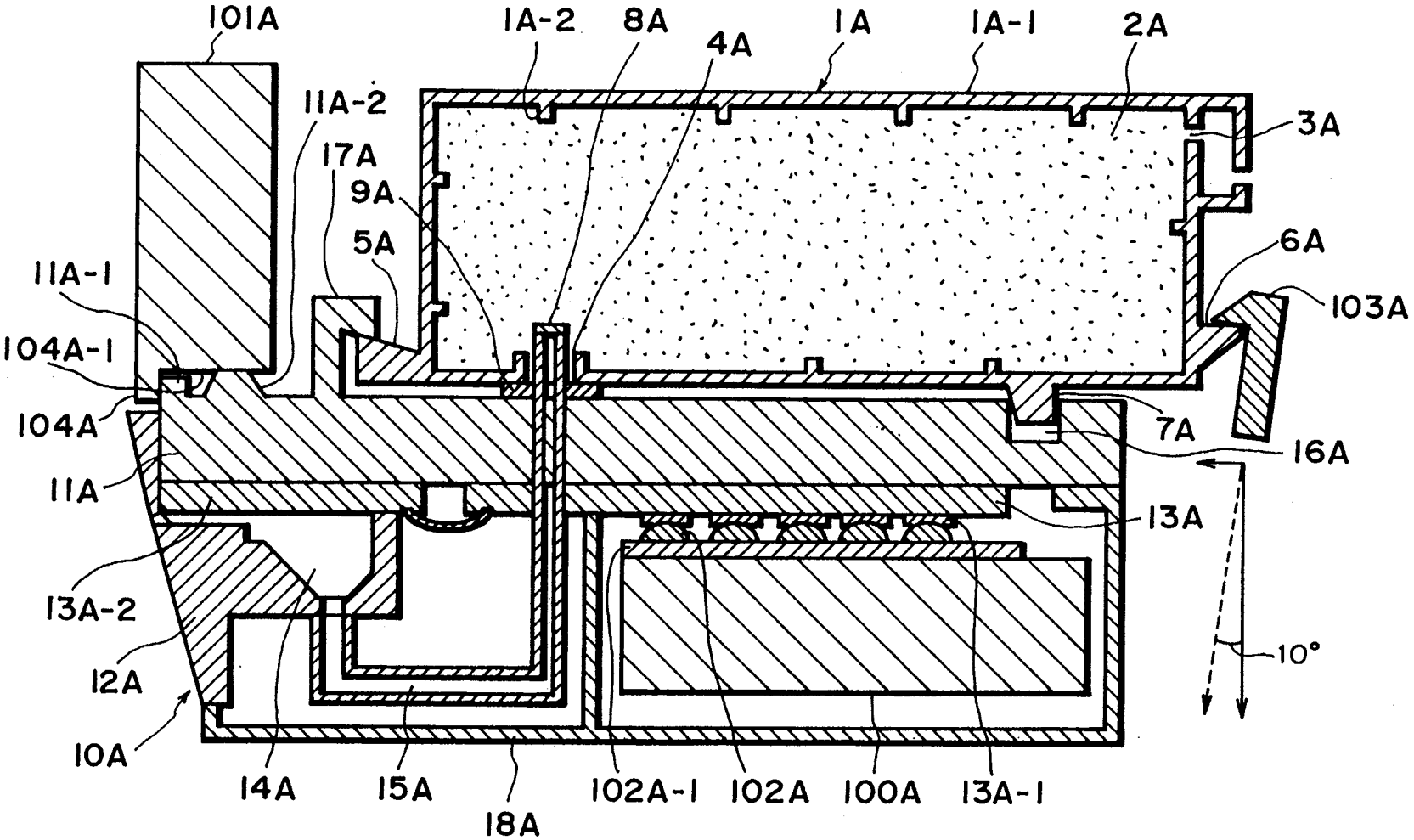
FIG. 1 is a sectional view illustrating an exchangeable recording head and an exchangeable ink container which are mounted on a carriage, according to an embodiment of the present invention.

Referring to FIG. 1, there is shown a recording head, an ink container and a carriage in an ink jet recording apparatus according to a first embodiment of the present invention. The connections among them are illustrated. A recording head 10A in this embodiment is of an ink jet type in which film boiling is produced in the ink in accordance with an electric signal by electrothermal transducer producing thermal energy in response to the electric signal.

All of the major parts of the constituent elements of the recording head 10A in FIG. 1, are laminated, by crimping, on a recording head base plate 11A with reference indexes of the projections 11A-1 and 11A-2 formed on the recording head base plate 11A.

In the horizontal direction in FIG. 1, the correct positioning is accomplished between a reference surface 104A-1 of a front plate 101A and a projection 11A-1, and in the vertical direction, the correct positioning is accomplished between the head positioning portion 104A and a projection 11A-2. Further in the direction perpendicular to the sheet of the drawing of FIG. 1, the correct positioning is accomplished between the head positioning portion 104A and an unshown projection, of the projection 11A-2, which projects to cover a portion of the head positioning portion 11A.

A heater board 13A-2 comprises electrothermal transducers (ejection heaters) aligned on a Si base plate and wiring leads of aluminum or the like for supplying electric power thereto. They are produced through film forming technique. The heater board 13A-2 is electrically connected by wire bonding with a recording head flexible base plate (head PCB) having electrical leads with pads 13A-1 for receiving electric signals from a main assembly of the apparatus. A top plate 12A having grooves is integrally made of polysulfone material or the like so as to be provided with partition walls for defining plural ink passages for the ejection heaters, respectively, a common liquid chamber for supplying through a conduit from an exchangeable ink container 1A to the ink passages, and orifices constituting plural ejection outlets corresponding to the ink passages. The top plate 12A is pressed to the heater board 13A-2 by an unshown spring and is fixed and sealed with a sealing material, thus constituting an ink ejection portion. The conduit 15A is hermetically connected to the top plate 12A in this embodiment, is penetrated through holes of the head PCB 13A and head base plate 11A to the opposite side of the head base plate 11A and is bonded and fixed at the penetrating portion to the head base plate 11A, thus permitting connection with the exchangeable ink container 1A.

An end of the conduit 15A which is connectable with the ink container 1A, is provided with a filter 8A to prevent introduction of foreign matter or air to the ejection portion. A head cover 18A is provided in order to protect the ejection portion of the recording head 10A and the electrical connection pads 13A-1 and in order to permit easy handling of the recording head 10A.

The exchangeable ink container 1A is substantially completely filled with ink absorbing material 2A containing the ink, in a container case 1A-1 having inside ribs 1A-2. The ink container 1A is provided with an ink supply port 4A for receiving the end of the conduit 15A having the filter 8A, for the ink communication, and an air vent 3A for permitting introduction of the ambient air into the exchangeable ink container 1A by the amount corresponding to the ink consumption from the ink container 1A, thus preventing production of too high vacuum therein. In order to prevent direct communication with the ambient air along inside surface of the wall of the container case 1A-1 to the ink supply port 4A, and therefore, in order to use the ink in the ink absorbing material 2A to the maximum extent by the capillary force, the inside surface of the wall of the container case 1A-1 is provided with ribs 1A-2, and in addition, the air vent 3A is disposed at a position away from the ink supply port 4A. The rib 1A-2 also functions to reinforce the container case 1A-1, and in addition, to improve the operativity upon the ink container exchanging manipulation. The initial quantity of the ink in the ink absorbing material 2A is slightly smaller than the maximum capacity of the ink absorbing material 2A for the functional purpose of permitting stabilized ejection of the ink by application of negative head (pressure) to the meniscuses at the ejection outlets when the container is connected with the recording head 10A, and also for the operational purpose of preventing ink leakage upon ink container exchanging manipulation even if some impact is applied thereto. The ink leakage from the air vent 3A may be limited by water repelling treatment of the ink absorbing material 2A adjacent the air vent 3A or by using additional water repelling absorbing material. The ink supply limit of the exchangeable ink container 1A is reached when the quantity of the ink in the ink absorbing material 2A is so small that the ink absorbing force of the ink absorbing material 2A becomes stronger than the ink supply force to the recording head 10A by the capillary force in the ink passage communicating with the ejection outlets, or when the quantity of the air introduced through the air vent 3A to the neighborhood of the filter 8A is so large that a large quantity of the air becomes supplied from the ink absorbing material 2A through the filter 8A.

As shown in FIG. 1, the connection between the recording head 10A and the exchangeable ink container 1A, is accomplished simultaneously with the connection between the recording head 10A and a carriage HC for carrying it, and they are made, in effect, integral by the urging force by a pressure hook 103A of the carriage HC.

Figure 4:
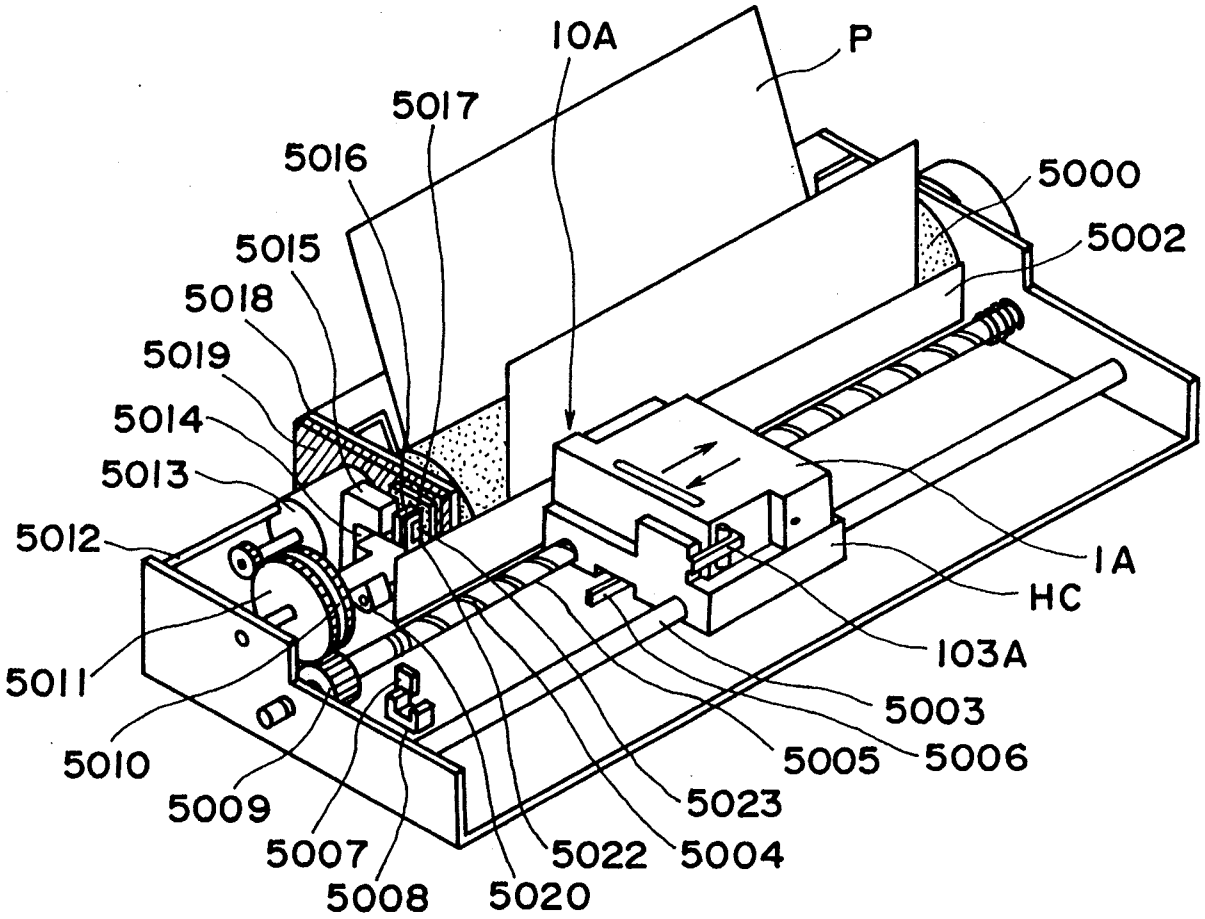
FIG. 4 is a perspective view of an exemplary ink jet recording apparatus to which the present invention is applicable.

Referring to FIG. 4, the operation of the recording apparatus will be briefly described to assist understanding of the operation and arrangement of the recording head in the recording apparatus.

FIG. 4 shows a recording apparatus usable with a recording head and an exchangeable ink container according to a first embodiment of the present invention. A recording material P is fed from the bottom to the top in the drawing, using a platen roller 5000. The recording material is pressed to the platen roller 5000 by a sheet confining plate 5002 along a carriage moving direction. The carriage HC is engaged and supported by a lead screw 5005 having a helical groove 5004 receiving therein a carriage driving pin and by a slider 5003 extending in parallel with the lead screw 5005. The lead screw 5005 functions as a driving source for the carriage, by rotation thereof. The carriage HC, is reciprocated to the left and right along the record surface of the recording material P confined on the platen roller 5000. The lead screw 5005 is rotated and controlled through drive transmission gears 5011, 5010 and 5009 in response to forward and backward rotation of a driving motor 5013.

A photocoupler constituted by elements 5007 and 5008 function as a home position detecting means to detect a lever 5006 of the carriage HC at the position of the photocoupler, in order to switch the rotational direction of the driving motor 5013. The image recording signal is fed to the recording head 10A in timed relation with the movement of the carriage HC carrying thereon the recording head 10A and the exchangeable ink container 1A. A supporting member 5016 supports a cap supporting member 5022 for supporting a cap for capping the front side of the recording head. A sucking means 5015 functions to suck the inside of the cap to suck the ink from the recording head through an opening 5023 of the cap to recover the ejection of the ink upon necessity. A guiding member 5019 permits movement of a cleaning blade 5017 to the front or rear. They are supported on a supporting plate 5018. The sucking means or the blade or the like may be of another known form.

A lever for determining the timing of the sucking and recovery operation moves in accordance with movement of a cam 5020 engaging with the carriage HC, and a driving force from the driving motor 5013 is controlled through a known transmission means including a clutch or the like. The recovery means is constructed so that when the-carriage comes to the home position, the desired processing is carried out at predetermined timed relations at a proper position by operation of the lead screw 5005. The mechanical and electrical connections of the recording head 10A and the exchangeable ink container 1A relative to the carriage HC, are accomplished in the following manner.

The carriage HC is provided with the front plate 101A positioned at a front side of the recording head adjacent to the platen roller, a flexible sheet 102A-1 having recording head driving electrodes 102A corresponding to the pads 13A-1 on the head PCB 13A of the recording head 10A, electric connection supporting plate 100A for urging the flexible sheet 102A-1 from the backside, a recording head positioning portion 104A upon mechanical mounting of the recording head 10A, and a pressure hook 103A for urging the exchangeable ink container 1A and the recording head 10A in one direction.

Between the flexible sheet and the electric connection supporting plate 100A, a rubber pad may be imposed. In such a case, resilient force is produced to press the flexible sheet from the backside thereof.

The front plate 101A has two positioning reference surfaces 104A-1, corresponding respectively to the first positioning projection 11A-1 and the second positioning projection 11A-2 on the base plate 11A of the recording head 10A. The pressure hook 103A of the carriage HC produces urging force in a direction inclined approximately 10 degrees from a movement direction of the carriage HC, that is, the pressing direction indicated by a broken line in FIG. 1, and therefore, the recording head 10A is urged in the two directions to the front plate 101A and the electric connection supporting plate 100A, by the urging force. Simultaneously, it is urged in the carriage HC movement direction adjacent the head positioning portion 104A with a pivot of the electric connection supporting plate 100A. The engaging mechanism of the pressure hook 103A of any known type, but a lever or the like permitting manipulation from the top side of the carriage HC, is preferable. In any case, upon the engaging action of the pressure hook 103A, the first positioning projection 11A-1 and the second position projection 11A-2 are contacted to the reference surfaces 104A-1 of the front plate 101A while the recording head 10A and the exchangeable ink container 1A are being slightly rotated on the carriage HC, and thereafter, the electric connection is established. For this reason, the correct positioning between the pads 13A-1 of the head PCB 13A and the head driving electrodes 102A are also assured.

Figure 2:
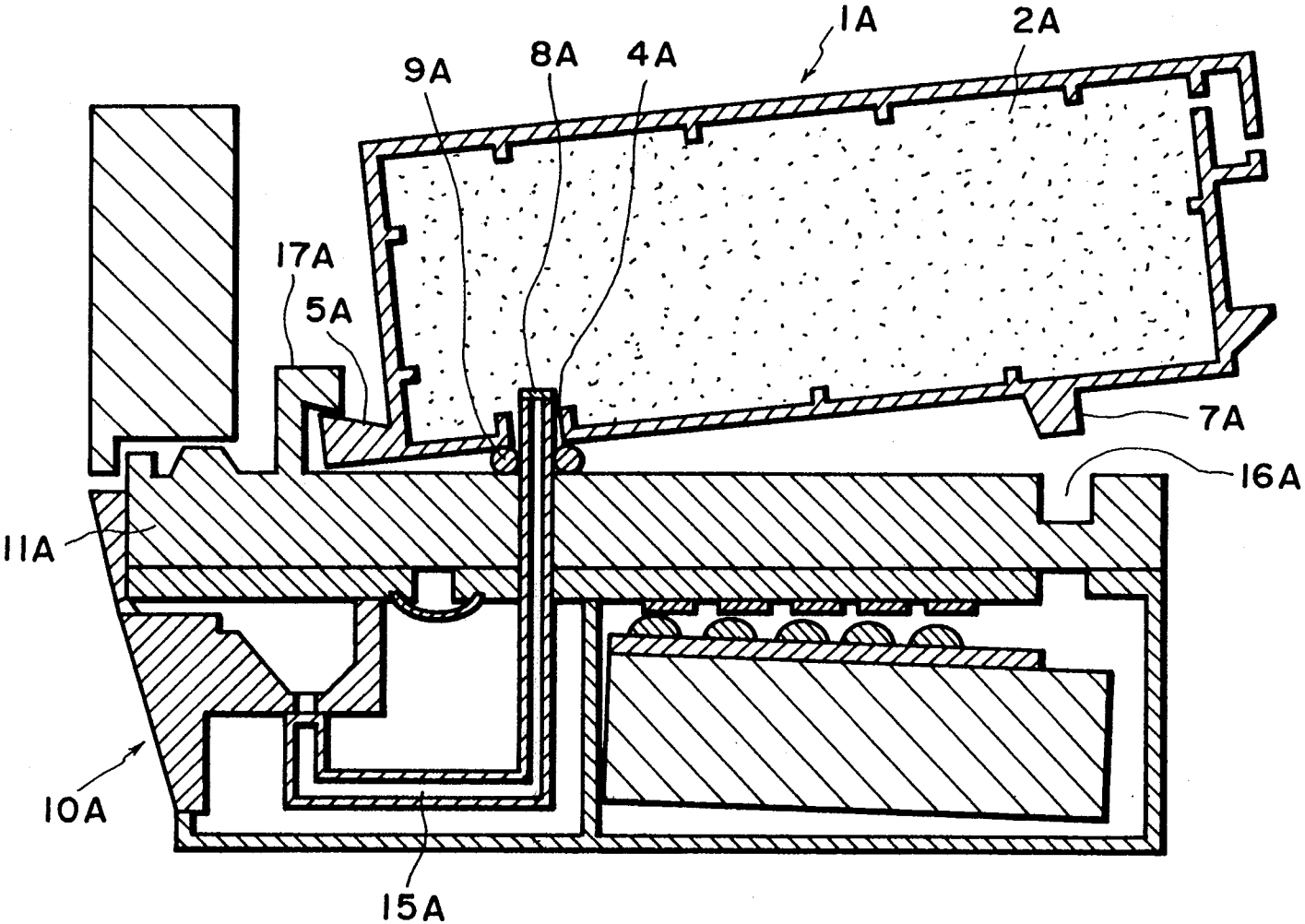
FIG. 2 is a sectional view illustrating mounting manipulation of the apparatus of FIG. 1.

Before the pressure application by the pressure hook 103A, the recording head 10A and the exchangeable ink container 1A are not completely connected, as shown in FIG. 2. In the state shown in FIG. 2, the carriage HC and the recording head 10A are separated, and the recording head 10A and the exchangeable ink container 1A, are separated. The engaging portions are only contacted at this time. As will be understood from FIG. 2, the engagement between the recording head. 10A and the exchangeable ink container 1A, starts between the engagement of an engageable hook 17A of the head base plate 10A and an engaging guide 5A of the exchangeable ink container 1A. By disposing the engaging position between the ink supply portion 4A and the head positioning portion 104A relative to the acting point of the pressure hook 103A of the carriage HC, the assured connection of the ink supply passage is enabled upon the pressure application by the hook.

As will be apparent from FIG. 2, from the standpoint of the connection between the recording head 10A and the exchangeable ink container 1A, when the pressure applied by the pressure hook 103A (force applying point), rotates the exchangeable ink container 1A in the clockwise direction in the Figure, the ink supply portion 4A is a force acting point with the fulcrum of the engaging portion between the engaging hook 17A and the engagement guide 5A. And therefore, the ink absorbing material 2A and the end of the conduit 15A having the connecting surface with the filter 8A, are connected, and in addition, a ring seal 9A of elastic material disposed between the head base plate 11A and the outer surface of the exchangeable ink container, is pressed and deformed therebetween with pressure contact to both of them. Thus, the communication between the inside of the exchangeable ink container 1A and the ambience can be completely prevented. If the prevention or the sealing is incomplete, the ambience is introduced into the inside of the exchangeable ink container 1A in accordance with ink consumption by the recording head 10A not through the ink absorbing material 2A but directly through this portion, and therefore, the ink absorbed in the ink absorbing material 2A is not efficiently used. As described hereinbefore, the pressure application direction of the pressure hook 103A is inclined by 10 degrees for the purpose of the correct positioning of the recording head 10A relative to the carriage HC in the direction of the surface of the drawing, and therefore, it is effective to apply the force in the direction perpendicular to the connecting direction also for the connection between the recording head 10A and the exchangeable ink container 1A.

In this embodiment, as shown in FIG. 1, the force in this direction is provided by the engagement between the container guide 7A and the container guide hole 16A. More particularly, the container guide 7A is contacted to the inside surface of the container guiding hole or groove 16A, and the force produced by the contact is effective to position the carriage HC at the head positioning portion 104A.

In this embodiment, in order to prevent application of too large mechanical force to the conduit 15A directly contacted to the ejecting portion, where the very high accuracy is desired in the recording head 10A, the play of the conduit 15A relative to the ink supplying portion 4A of the exchangeable ink container 1A is selected to be larger than the play of the container guide 7A relative to the guiding groove 16A. Therefore, the force in the direction perpendicular to the engaging direction of the exchangeable ink container is all received by the connecting portion with the container guide 7A. It is a possible alternative structure that the perpendicular force is simultaneously received by the engaging portion between the engaging hook 103A and the engagement guide 5A.

The connecting portion of the container guide 7A in this embodiment is also given a function of preventing rotation of the exchangeable ink container 1A on the surface of the recording head base plate 11A. The plays at the acting surface are so selected that too large force can similarly be avoided. It is preferable that the connecting portion of the container guide 7A is disposed adjacent to the engaging portion of the pressure hook 103A (force applying point) in the structure of FIG. 1 embodiment so as to avoid too large force applied there, from the standpoint of the mechanical strength of the constituent members. It is further preferable that if the container guide 7A can be disposed outside the pressure or urging means (force application point), it is disposed as far as possible. L The ring seal 9A is of relatively thick elastic ring in this embodiment so as to permit the play in the ink supply portion 4A and to permit a wider connecting portion relative to the outer wall of the exchangeable ink container 1A.

As described in the foregoing in conjunction with FIGS. 1 and 2, in this embodiment, the recording head 10A and the exchangeable ink container 1A are generally engaged on the carriage HC, and thereafter, the exchangeable ink container 1A is urged in one direction, by which the positioning and connection between the carriage HC and the recording head 10A and the connection between the recording head 10A and the exchangeable ink container 1A, are assuredly accomplished simultaneously. Thus, ink container and the recording head are independently connectable.

In this embodiment, the electric connection between the carriage HC (the main assembly of the recording apparatus) and the recording head 10A, are simultaneously established. Therefore, the operativity is good upon the exchange of the recording head 10A and/or the exchangeable ink container 1A. However, the electric connection may be accomplished through a separate connector to permit a higher latitude to further assure the positioning of the recording head and the connection with the exchangeable ink container.

Figure 3:
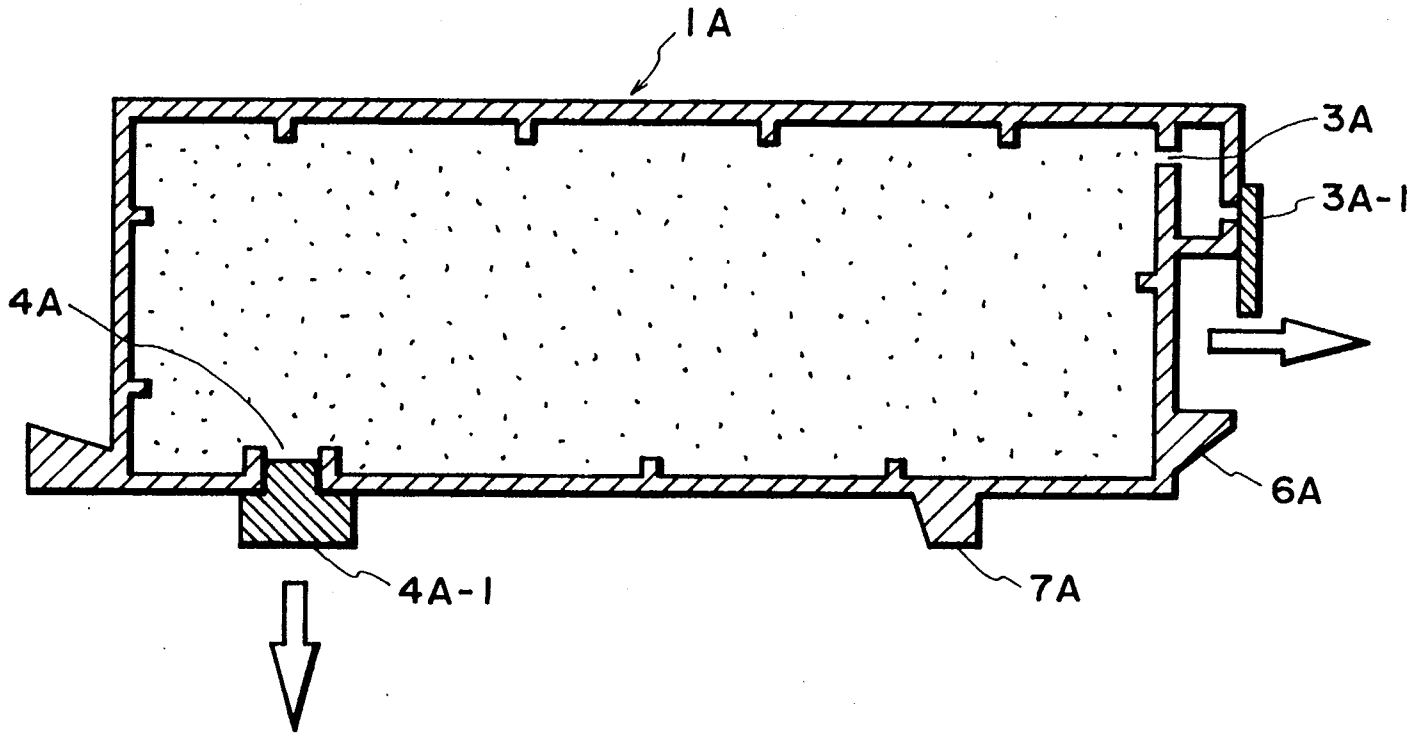
FIG. 3 is a sectional view illustrating the exchangeable ink container according to FIG. 1 embodiment.

FIG. 3 is a sectional view illustrating the exchangeable ink container 1A before start of use. In order to prevent leakage or evaporation of the ink during transportation, there is provided a sealing member including a vent seal 3A-1 and a supply port seal 4A-1 at the air vent 3A and the ink supply portion 4A, respectively. The sealing member is removable upon start of use of the exchangeable ink container 1A, by pulling it in the direction of an arrow.

In this embodiment, the description has been made as to a monochromatic recording apparatus having a single recording head. However, the embodiment is applicable to a color ink jet recording apparatus having plural recording heads capable of ejecting different color inks (four recording heads for ejecting black, cyan, magenta and yellow inks, for example). The present invention is applicable to a single recording head capable of ejecting plural color inks. In that case, the means for limiting the connecting position and direction for the exchangeable container is added.

As described in the foregoing, according to this embodiment of the present invention, the connecting direction between the carriage HC and the recording head 10A and the connecting direction between the recording head 10A and the exchangeable ink container 1A, are substantially the same, and in addition, they are simultaneously connected by urging the exchangeable ink container 1A. Therefore, the operativity in the recording head and/or exchangeable ink container exchanging manipulation, and the mechanical and/or electrical connection therebetween is assured by a simple structure.

Figure 5:
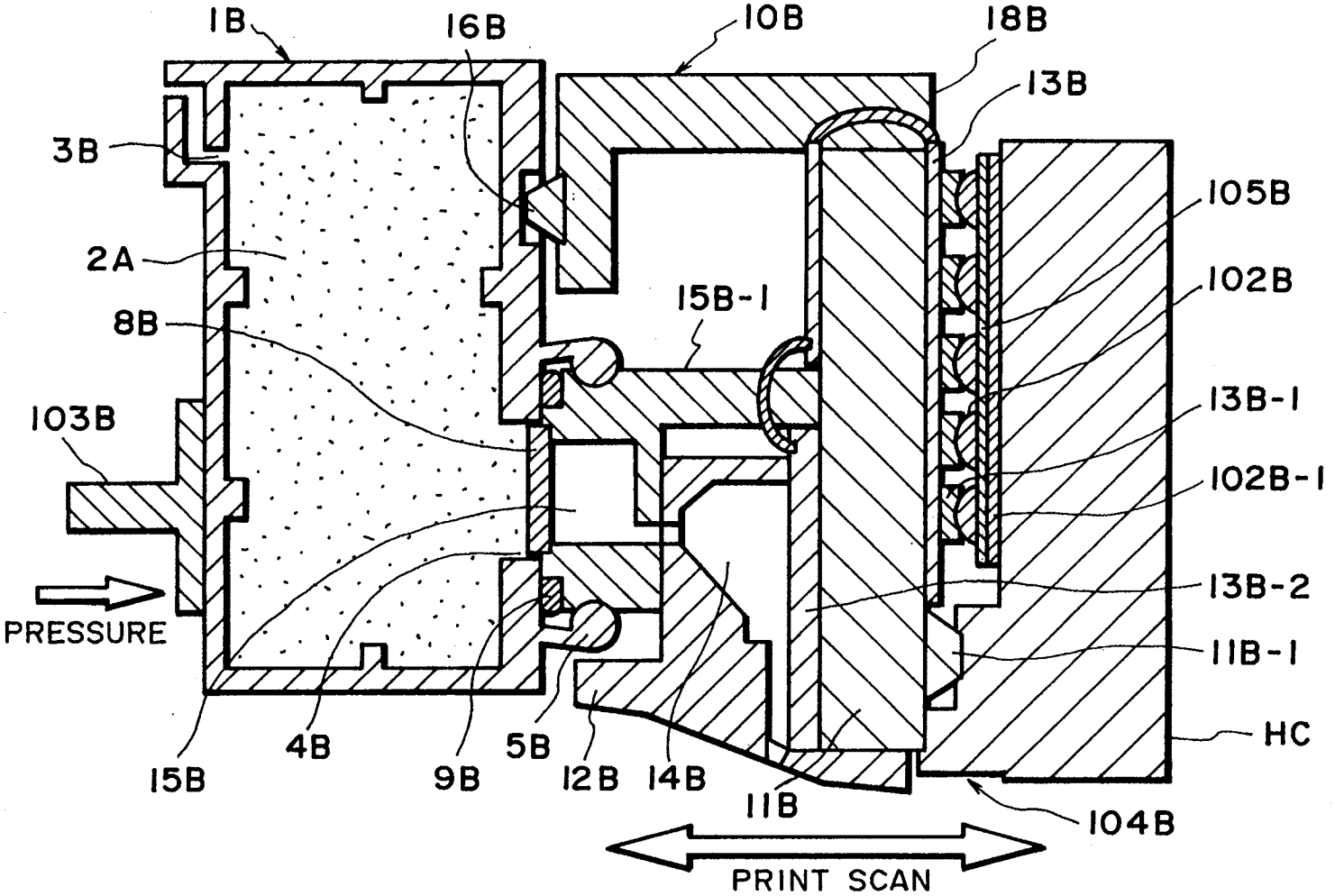
FIG. 5 is a sectional view illustrating an exchangeable recording head and an exchangeable ink container which are mounted on a carriage, according to a second embodiment of the present invention.

Referring to FIG. 5, an ink jet recording apparatus according to a second embodiment of the present invention will be described. FIG. 5 illustrates the connection between the recording head and/or the exchangeable ink container and the carriage HC. The same reference numerals as in the foregoing embodiment are assigned to the elements having the corresponding functions, and the detailed description thereof are omitted for simplicity.

In this embodiment, the recording head 10B scanningly moves above the surface of the recording material while ejecting the ink downwardly. Therefore, the positioning of the recording head 10B in the direction of the surface of the drawing relative to the carriage HC is accomplished, utilizing the weight of the recording head 10B itself, by press-contacting the cut-away portion (not shown) formed in a bottom end of the head baseplate 11B to a reference surface of the electric connection supporting plate of the carriage HC. As shown in FIG. 5, for the purpose of correct positioning of the recording head 10B in the scanning direction, the pressure of the pressure means 103B which is an urging or pressing member on the carriage acts on the recording head 10B through the exchangeable ink container, so that the reference surface of the projection 11B-1 of the recording head 10B is press-contacted to the reference surface of the carriage at the recording head positioning portion 104B.

For the electric connection establishment in this embodiment, similarly to the foregoing embodiment, the pads 13B-1 of the head PCB 13B are pressed to the head driving electrodes 102B on the carriage HC by the pressure through the exchangeable ink container 1B. However, in this embodiment, the electric wiring of the recording head 10B is disposed on a flexible head PCB 13B, and in addition, an elastic member 105B is provided on such a side of the recording head 10B of the head baseplate 11B as is opposite from the ejection portion, and therefore, the reliability of the connection is improved as compared with the foregoing embodiment in which the recording head 10B is slightly rotated upon the mounting.

In a modification, in order to prevent the oblique mounting of the recording head, a reference projection (not shown) for the correct positioning is provided adjacent the rear electrodes of the head base plate 11B, and in order to further assure the electric connection, an elastic member having larger thickness and higher elasticity than in the foregoing embodiment is disposed as a lower layer of the recording head electrode, so that the proper pressure is assured between the recording head PCB and the head driving electrode upon the pressure contact of the reference projection. In other words, in this embodiment, the pressure applied to the recording head through the exchangeable ink container is received by the reference projections disposed at the front and rear of the head base plate.

The conduit 15B in this embodiment, as contrasted to the first embodiment, is disposed right above the liquid chamber 14B, and is so constructed that it is connected with the exchangeable ink container 1B at the ejecting portion side of the head base plate 11B. Since it does not penetrate through the head base plate 11B, the conduit 15B can be easily made shorter and larger, so that flow resistance of the conduit 15B can be reduced as compared with the first embodiment. Therefore, the pressure loss or drop upon the ink supply to the recording head 10B can be increased. This is advantageous when the recording frequency is increased. On the other hand, the pressure or force for the connection between the exchangeable ink container 1B and the recording head 10B is more easily applied to the ejection portion through the conduit 15B, and therefore, in this embodiment the mechanical strength of the liquid passage forming member 15B-1 and, in addition, the conduit 15B is directly fixed and supported on the head base plate 11B. The hermetical sealing of the connecting portion between the conduit 15B and the liquid chamber 14B is accomplished by application of sufficient sealing material. On the contrary, the structure of the recording head 10B of this embodiment is such that the heater board 13B and the top plate 12B are laminated on the head base plate 11B, and therefore, the pressure or force acting through the exchangeable ink container 1B may be adjusted to a proper level, and thereafter, the connecting force is reinforced.

Figure 6:
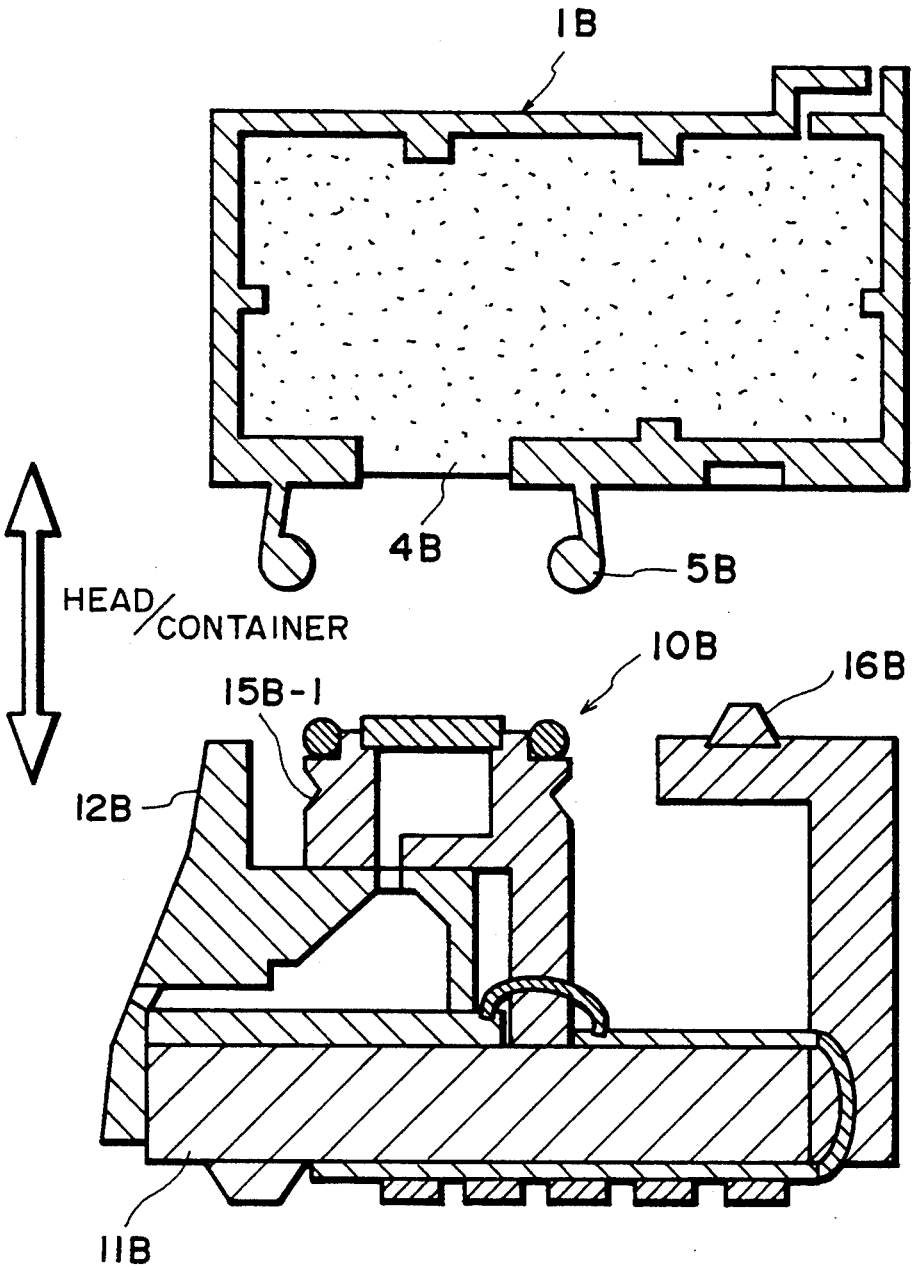
FIG. 6 is a sectional view illustrating mounting or dismounting manipulation of the recording head and the exchangeable ink container, according to the second embodiment of the present invention.
Figure 7:
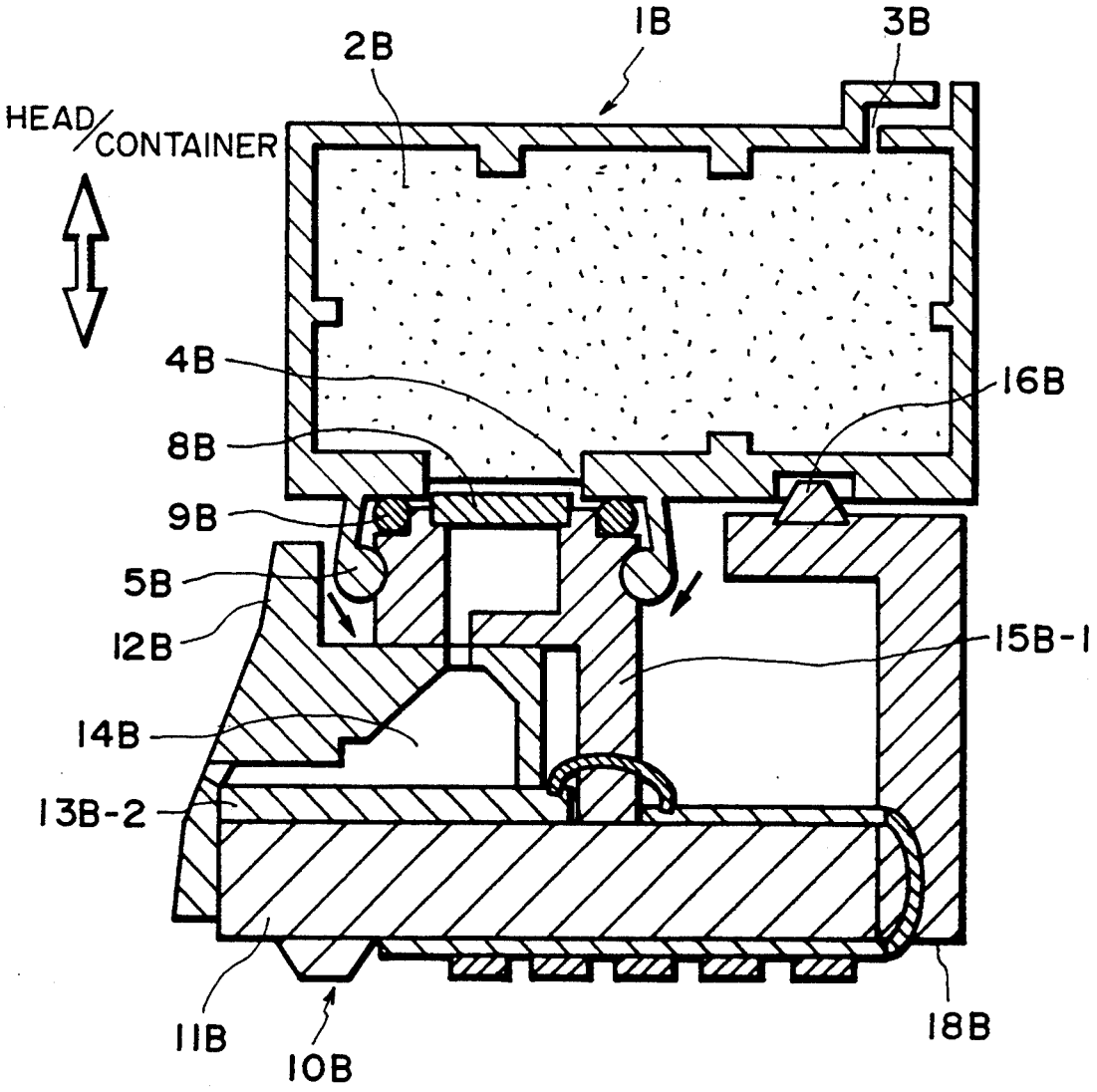
FIG. 7 illustrates connection between the recording head and the exchangeable ink container according to the second embodiment of the present invention.

Referring to FIGS. 5, 6 and 7, the description will be made as to the mounting and dismounting of the recording head 10B and the exchangeable ink container 1B. The recording head 10B and the exchangeable ink container 1B of this embodiment, as shown in FIGS. 6 and 7, may be mounted or dismounted after they are taking out of the recording apparatus. It is a possible alternative for making easier the mounting or dismounting thereof relative to the carriage HC that an auxiliary means to permit mounting or dismounting manipulation on the carriage HC. As will be understood from FIGS. 6 and 7, the mounting or dismounting of the recording head 10B and the exchangeable ink container 1B relative to each other, is carried out using a container guide 16B and an engaging guide 5B of the ink supply portion 4B.

The container guide 16B functions to roughly limit rotation of the exchangeable ink container 1B on the top surface of the recording head 10B, and there is provided a play to avoid objection to the engagement of the engaging guide 5B for the ink supply portion 4B. For the purpose of connection of the ink supply portion 4B, the engagement is established between the engaging guide 5B, which is elastically deformable and provided in the exchangeable ink container 1B, and a recess of the liquid passage forming member 15B-1 supported on the head base plate 11B of the recording head 10B. For this purpose, the free end of the engaging guide 5B is rounded.

In this embodiment, three of such engaging guides 5B (one is not shown) are provided, so that the engaging portion is connected with liquid passage forming member 15B-1 in the form of a cylinder at three points.

The number of the engaging guides may be further increased, or it may be cylindrical. The engaging portion of the passage forming member may be other than non-cylindrical.

In order to make the mounting and dismounting manipulation easier, the elastic force of the engaging guide 5B is not strong, and therefore, in the state of FIG. 6, the connection engagement of the ink supply portion 4B is not sufficient. In addition, the deformation and contact of the ring seal 9B and the contact between the filter 8B and the ink absorbing material 2B, are also insufficient. The connecting or jointing force is of such a degree as to permit integral exchange of the recording head 10B and the exchangeable ink container 1B.

The recording head 10B and the exchangeable ink container 1B thus connected lightly, is mounted on the carriage HC of the main assembly of the recording apparatus, as shown in FIG. 5. As described hereinbefore, a reference surface of the positioning projection 11B-1 of the recording head 10B is engaged to the head positioning portion 104B of the carriage HC, and thereafter, the exchangeable ink container 1B is pressed by the pressure application means 103B on the carriage HC in the direction indicated by a broken line in FIG. 5. By pressing the exchangeable ink container 1B, the recording head 10B is crimped on the carriage HC, and the recording head 10B and the exchangeable ink container 1B are completely connected. As shown in FIG. 5, the engaging guide 5B of the exchangeable ink container 1B is inserted further deeply beyond the limitation of the recess of the passage forming member 15B-1, so that the filter 8B of the end of the conduit 15B and the ink absorbing material 2B of the ink supply portion 4B are sufficiently closely contacted to permit ink supply. Until the outer wall of the exchangeable ink container 1B is contacted to the top surface of the end of the conduit 15B, the ring seal 9B elastically deforms to provide hermetical sealing to prevent direct communication with the ambience at the connecting portion. Even in this state, the container guide 16B permits sufficient clearance in the connecting direction between the recording head 10B and the exchangeable ink container 1B so as to avoid too large force in the connection at the ink supply portion 4B.

Figure 8:
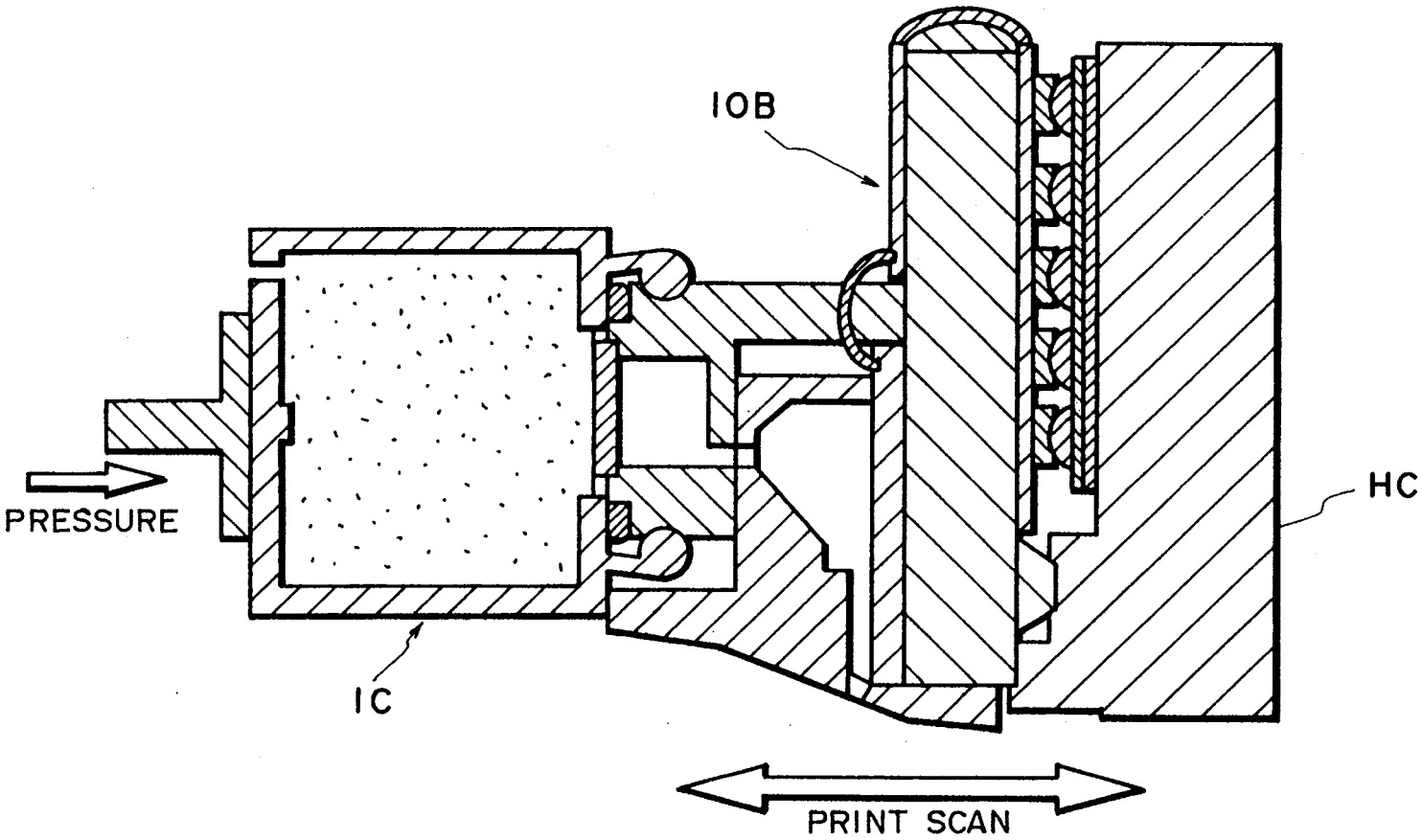
FIG. 8 is a sectional view of an exchangeable ink container according to a modification of the second embodiment.

In this sense, the exchangeable ink container 1C may be in the form of a cylinder, as shown in FIG. 8, to permit free connecting direction of the exchangeable ink container 1C on the top surface of the recording head (rotatable structure), thus eliminating the necessity of the container guide.

As described in the foregoing, according to this embodiment, the connecting or engagement direction between the carriage HC and the recording head 10B and that between the recording head 10B and the exchangeable ink container 1B, are made completely the same, and in addition, they are connected simultaneously by urging the exchangeable ink container 1B. Therefore, the operativity is good upon exchange of the recording head and/or the exchangeable ink container. Furthermore, the mechanical or electrical connection is further assured with simple structure. Additionally, since the recording head 10B and the exchangeable ink container 1B Can be unified even when they are not mounted on the carriage, the operativity in the exchanging manipulation can be further improved.

Figure 9:
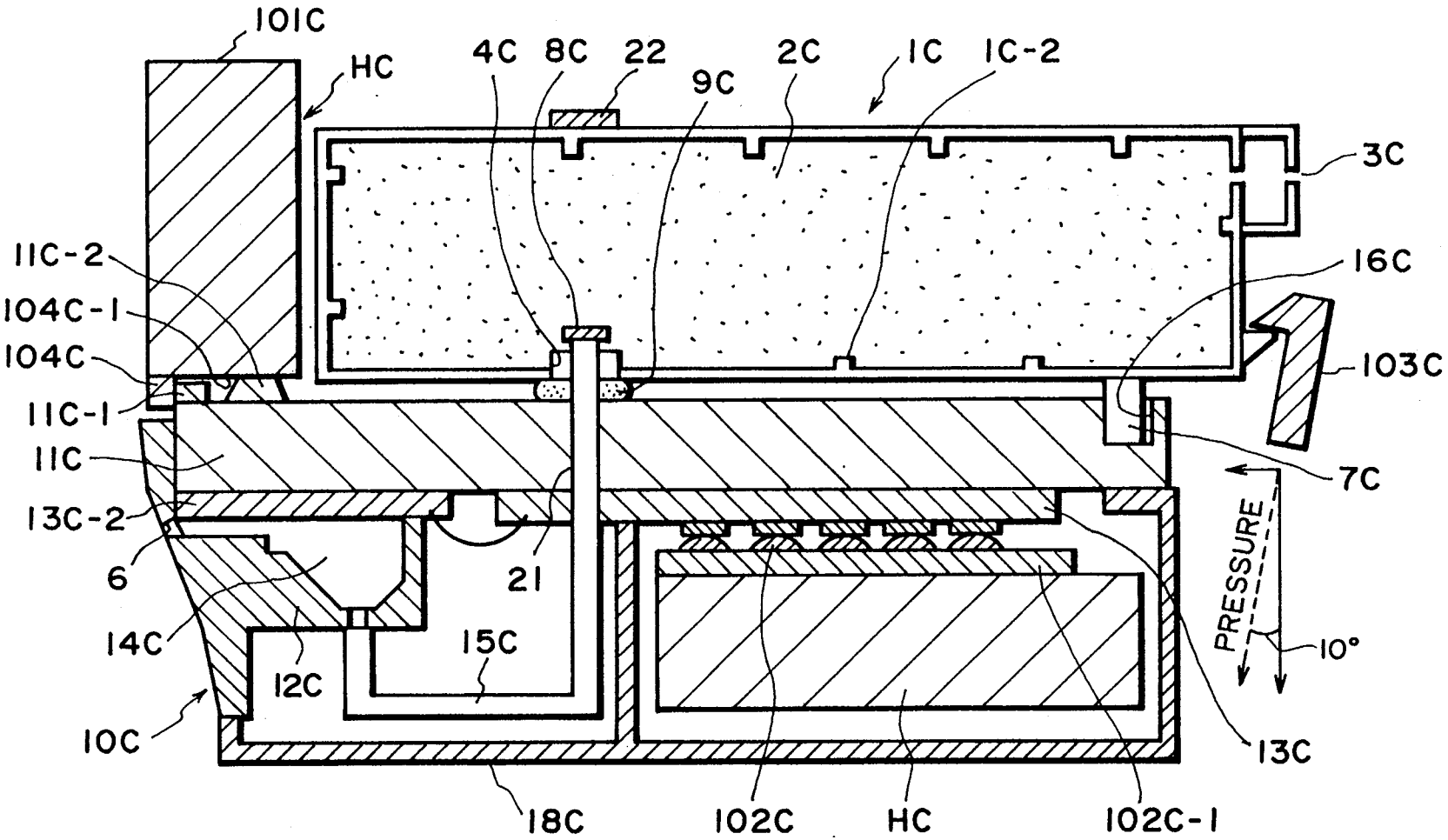
FIG. 9 is a sectional view of a device according to a third embodiment of the present invention.

Referring to FIG. 9, a third embodiment of the present invention will be described. The recording head 1 of this embodiment is of an ink jet type in which film boiling is produced in the ink in response to electric signal by thermal energy provided by electrothermal transducer responsive to the electric signal.

All of the major parts of the constituent elements of the recording head 101C in FIG. 9, are laminated, by crimping, on a recording head base plate 11C with reference indexes of the projections 11C-1 and 11C-2 formed on the recording head base plate 11C.

In the horizontal direction in FIG. 9, the correct positioning is accomplished between a reference surface 104C-1 of a front plate 101C and a projection 11C-1, and in the vertical direction, the correct positioning is accomplished between the head front plate 101C and a projection 11C-2. Further in the direction perpendicular to the sheet of the drawing of FIG. 9, the correct positioning is accomplished between the front plate 101C and an unshown projection, of the projection 11C-2, which projects to cover a portion of the front plate 101C.

A heater board 13C-2 comprises electrothermal transducers (ejection heaters) aligned on a Si base plate and wiring leads of aluminum or the like for supplying electric power thereto. They are produced through film forming technique. The heater board 13C-2 is electrically connected by wire bonding with a recording head flexible base plate (head PCB 13C) having electrical leads with pads for receiving electric signals from a main assembly of the apparatus. A top plate 12C having grooves is integrally made of polysulfone material or the like so as to be provided with partition walls for defining plural ink passages for the ejection heaters, respectively, a common liquid chamber for supplying through a conduit from an ink container 1C to the ink passages, and orifices constituting plural ejection outlets corresponding to the ink passages. The top plate 12C is pressed to the heater board 13C by an unshown spring and is fixed and sealed with a sealing material, thus constituting an ink ejection portion. The conduit 15C is hermetically connected to the top plate 12C in this embodiment, is penetrated through holes of the head PCB 13C and head base plate 11C to the opposite side of the head base plate 11C and is bonded and fixed at the penetrating portion to the head base plate 11C, thus permitting connection with the ink container 1C.

An end of the conduit 15C which is connectable with the ink container 1C, is provided with a filter 8C to prevent introduction of foreign matter or air to the ejection portion. A head cover 18C is provided in order to protect the ejection portion of the recording head 10C and the electrical connection pads and in order to permit easy handling of the recording head 10C.

The ink container 1C is substantially completely filled with ink absorbing material 2C containing the ink, in a container case having inside ribs 1C-2. The ink container 1C is provided with an ink supply port 4C for receiving the end of the conduit 15C having the filter 8C, for the ink communication, and an air vent 3C for permitting introduction of the ambient air into the ink container 1C by the amount corresponding to the ink consumption from the ink container 1C, thus preventing production of too high vacuum therein. In order to prevent direct communication with the ambient air along inside surface of the wall of the container case to the ink supply portion 4C, and therefore, in order to use the ink in the ink absorbing material 2C to the maximum extent by the capillary force, the inside surface of the wall of the container case is provided with ribs 1C-2, and in addition, the air vent 3C is disposed at a position away from the ink supply portion 4C. The rib 1C-2 also functions to reinforce the container case, and in addition, to improve the operativity upon the ink container exchanging manipulation. The initial quantity of the ink in the ink absorbing material 2C is slightly smaller than the maximum capacity of the ink absorbing material 2C for the functional purpose of permitting stabilized ejection of the ink by application of negative head (pressure) to the meniscuses at the ejection outlets when the container is connected with the recording head 10C, and also for the operational purpose of preventing ink leakage upon ink container exchanging manipulation even if some impact is applied thereto. The ink leakage from the air vent 3C may be limited by water repelling treatment of the ink absorbing material 2C adjacent the air vent 3C or by using additional water repelling absorbing material. The ink supply limit of the ink container 1C is reached when the quantity of the ink in the ink absorbing material 2C is so small that the ink absorbing force of the ink absorbing material 2C becomes stronger than the ink supply force to the recording head 10C by the capillary force in the ink passage communicating with the ejection outlets, or when the quantity of the air introduced through the air vent 3C to the neighborhood of the filter 8C is so large that a large quantity of the air becomes supplied from the ink absorbing material 2C through the filter 8C.

Figure 10:
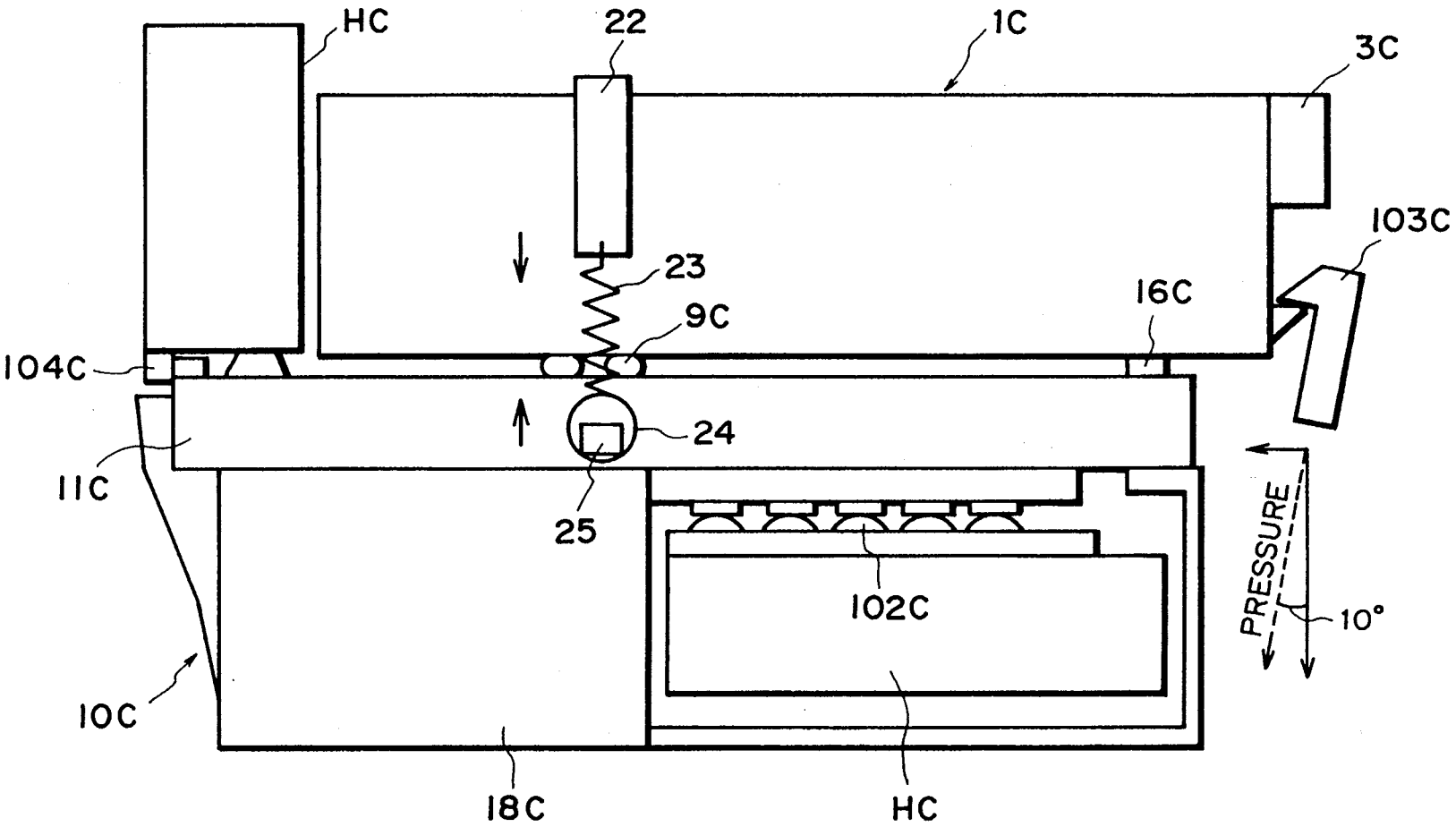
FIG. 10 illustrates the connection among an ink container, a recording-head and a carriage, according to a third embodiment of the present invention.
Figure 11:
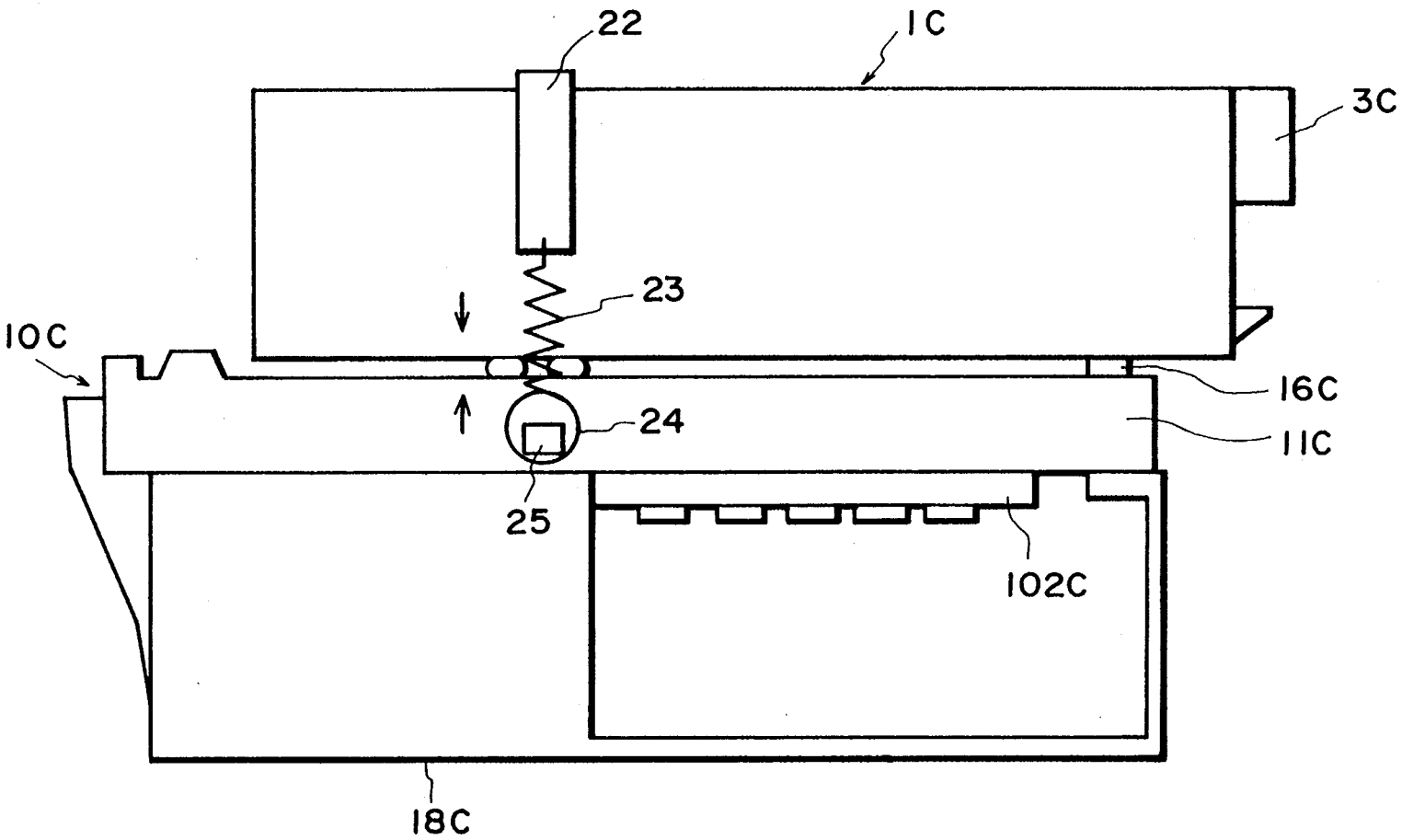
FIG. 11 illustrates the connection between the ink container and the recording head, according to a third embodiment of the present invention.

Referring to FIG. 10, the connections or engagements among the ink container, the recording head and the carriage, will be described.

The connection between the recording head 10C and the ink container 1C are accomplished in the following manner. As shown in FIG. 10, a container belt 22 having an end (not shown) fixed to the head base plate 11C of the recording head 10C is disposed along the outer surface of the ink container 1C adjacent the ink passage connecting portion, and a container belt hook 24 in the form of a ring at an end of a container belt spring 23 connected to the other end of the container belt, is pulled and hooked on a projection 25 of the head base plate 11C, by which they are unified by the urging force of the container belt spring 23. Thus, the connection between the ink container 1C and the recording head 10C, can be carried out outside the carriage HC. First, the container guide of the ink container 1C is engaged into a container guide hole 16C of the head base plate 11C. The position of this engagement is disposed close to an acting point of the pressure hook 103C of the carriage HC and the ink passage connecting portion (ink supply portion) is disposed as far as possible from an acting point of the pressure hook 103C, by which the component force of the pressure at the ink supply portion upon the mounting of the carriage HC can be reduced, thus permitting the assured engagement at the ink passage connecting portion. As will be understood from FIG. 10, if the consideration is made to the connection between the recording head 10C and the ink container 1C, the pressure or force of the pressure hook 103C (force applying point) to the ink container 1C rotates the ink container 1C in the clockwise direction in the Figure. At this time, the ink passage connecting portion is a force acting point with the fulcrum of the engaging portion of the container guide 7C, and therefore, the force against the engagement is produced in the ink passage connecting portion. In the ink passage connecting portion, by the connecting force provided by the container belt 22, the ink absorbing material 2C and the filter 8C are press-contacted with each other to establish the connection at the ink passage connecting portion, and in addition, the elastic ring seal 9C interposed between the head base plate 11C and the ink container 1C outer surface, is pressed and deformed to be in close contact with both of them, so that the connection between the ambience and the inside of the ink container 1C is completely prevented at the ink passage connecting portion. If this sealing is insufficient, the introduction of the ambient air into the inside of the ink container 1C in accordance with the consumption of the ink to the recording head 10C, occurs directly through this portion not through the ink absorbing material 2C with the result that the efficient use of the ink in the ink absorber 2C is difficult.

However, in this embodiment, the connecting force adjacent the ink passage connecting portion provided by the container belt spring 23 is made sufficiently larger than the acting force of the pressure hook 103C, and therefore, the assured ink communication is established upon the mounting to the carriage HC.

As described hereinbefore, the pressure hook 103C provides the pressing direction which is inclined by 10 degrees so as to position the recording head 10C relative to the carriage HC to the left on the Figure. If the pressure hook 103C is hooked on the head base plate 11C, the configuration of the head base plate will be complicated. Therefore, in this embodiment, it is hooked on the ink container 1C in which the tolerance in the positional accuracy is relatively large. When the connection between the recording head 10C and the ink container 1C is considered, the force in a direction perpendicular to the connecting direction is produced. However, in this embodiment, as shown in FIG. 9, such a force is received by the engagement between the container guide 7C and a hole of a container guide 16C. Therefore, the container guide 7C is contacted to the inside surface at the left in the drawing of the container guide groove 16C, and the recording head 10C received the force at the head positioning portion, so that it is correctly positioned relative to and connected with the carriage HC.

In this embodiment, in order to prevent too large mechanical force application to the conduit directly connected to the ejecting portion which requires particularly high accuracy in the recording head 10C, the play of the conduit in the ink supply portion 4C of the ink container 1C is selected to be larger than the play of the container guide 7C in the container guide groove 16C, so that all of the force in a direction perpendicular to the connecting direction of the ink container 1C is received by the connecting portion. The connecting portion of the container guide 7C in this embodiment is given a further function of preventing rotation of the ink container 1C on the head base plate 11C, and the play thereof on the acting surface is selected to avoid too large force to the liquid passage, similarly.

The ring seal 9C, in order to permit the play of the ink supply portion 4C, is so selected to provide a wide connecting portion relative to the ink container 1C outer surface, by taking a form of slightly thick elastic ring.

Figure 12:
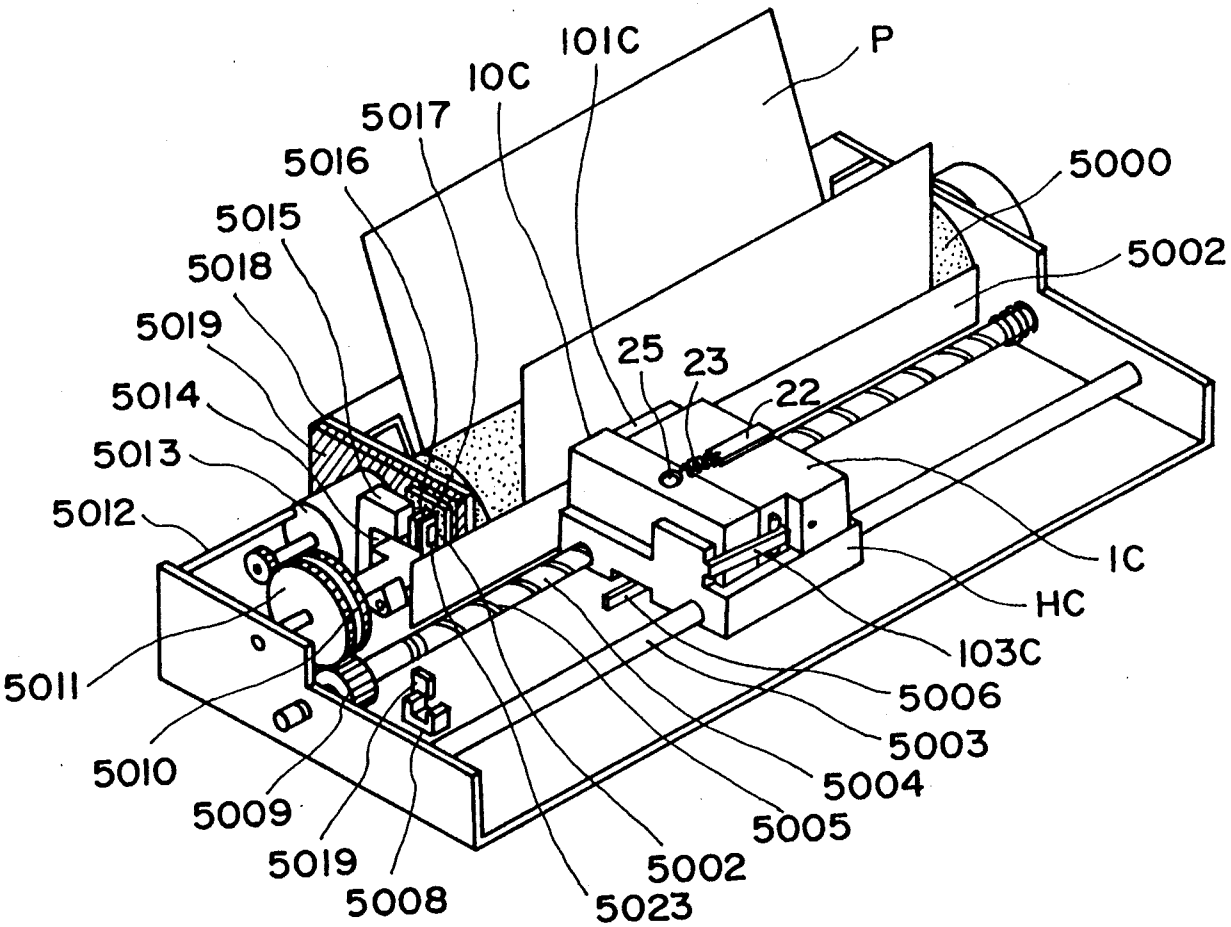
FIG. 12 is a perspective view of an exemplary ink jet recording apparatus according to a third embodiment of the present invention.

Referring to FIG. 12, the description will be made as to the mechanical and electrical connection between the carriage HC and the recording head 10C. The same reference numerals as in the foregoing embodiments are assigned for the elements having the corresponding functions.

The carriage HC is provided with a front plate 101C at a front side of the recording head (platen roller side), electric connection supporting plate 102C-1 for supporting recording head driving electrodes corresponding to the pads on the PCB 13C of the recording head 10C, a head positioning portion 104C upon mechanical mounting of the recording head 10C, and a pressure application hook 103C for urging the ink container 1C and the recording head 10C in one direction. The pressure hook 103C of the carriage HC is such as to produce the urging force in a direction approximately 10 degrees away from the moving direction of the carriage HC, that is, the direction shown in FIG. 9. Therefore, the recording head 10C is urged by the urging force in two directions to the front plate 101C and to the electric connection supporting plate 102C-1. Simultaneously, it is urged also in the carriage HC movement direction at the head positioning portion 104C with the fulcrum of the electric connection supporting plate 102C-1. The pressure applying engaging mechanism of the hook 103C may be of any known form, but a lever or the like manipulatable at the top of the carriage HC is desirable. In any case, upon the engagement of the pressure hook 103C, the electric connection is established after the positioning projections 11C-1 and 11C-2 are contacted to the reference surface of the front plate 101C while the recording head 10C and the ink container 1C are being slightly rotated on the carriage HC, and therefore, the positioning between the pads of the head PCB 13C and the head driving electrodes 102C, are assured, too.

As described in the foregoing, according to this embodiment, the ink container 1C and the recording head 10C are sufficiently engaged, and thereafter, the ink container 1C is urged by the pressure hook 103C, by which the positioning of the carriage HC and the recording head 10C is assuredly carried out with a simple structure. In addition, the recording head 10C and the ink container 1C may be removed from the carriage HC, and they can be connected or separated relative to each other outside the main assembly of the recording apparatus, and therefore, the exchanging manipulation is made easier.

In addition, according to this embodiment, the electric connection is established simultaneously between the carriage (main assembly of the recording apparatus) HC and the recording head 10C, and the operativity in the exchange of the recording head 10C and the ink container 1C is good. However, the electric connection may be established using a separate connector or the like so as to provide a higher latitude to further assure the positioning of the recording head 10C and the connection with the ink container 1C.

The foregoing descriptions have been made as to a monochromatic recording apparatus having a recording head 10A, 10B or 10C, but the present invention is applicable to a color ink jet recording apparatus having-plural recording heads capable of ejecting different color inks (black, cyan, magenta and yellow recording heads (four heads), for example). The present invention is applicable to a single recording head capable of ejecting plural color inks. In that case, the limiting means for limiting the connecting position and direction for the ink container is added. In the foregoing embodiments, the ink is retained by the ink absorbing material as an example, but the ink container may be in the form of a bladder type.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects, of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording colors or densities. The present invention is effectively applicable to an apparatus having at least one of a monochromatic mode mainly with black, a multi-color mode with different color ink materials and/or a full-color mode using the mixture Of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left unused, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus usable with an ink jet recording head and an ink container having a connecting portion for supplying ink to the recording head, wherein the recording head and the ink container are separable from each other, and are connected in use, said apparatus comprising:

a supporting member for supporting the recording head and the ink container, said supporting member having an abutment portion for being abutted by the recording head;

an urging member, provided in said supporting member, for urging an end of the ink container to mount the recording head and the ink container on said supporting member; and a pivot portion, provided in said supporting member, about which the ink container is rotated to the recording head by said urging member, with the connecting portion of the ink container being substantially between said pivot portion and said urging member.

2. An apparatus according to claim 1, wherein the recording head and said supporting member are electrically connected by the urging action of said urging member.

3. An apparatus according to claim 1, wherein the recording head comprises an electrothermal transducer for generating thermal energy.

4. An ink jet recording apparatus for ejecting ink to effect recording on a recording material, said apparatus comprising:

an ink jet recording head comprising an ink ejection outlet for ejecting the ink to the recording material and an ink receptor portion for receiving a supply of the ink for effecting the recording;

an ink container for containing the ink, said ink container comprising a connecting portion and an ink supply portion for supplying the ink to the recording head, wherein said ink container is separably connectable with said recording head, and when said ink container and said recording head are connected, said ink receptor portion and said ink supply portion are connected for ink communication;

a supporting member for supporting the recording head and the ink container, said supporting member having an abutment portion for being abutted by said recording head;

an urging member, provided in said supporting member, for urging an end of said ink container to mount said recording head and said ink container on said supporting member; and a pivot portion, provided in said supporting member, about which said ink container is rotated to said recording head by said urging member, with the connecting portion of said ink container being substantially between said pivot portion and said urging member.

5. An apparatus according to claim 4, wherein said recording head and said supporting member are electrically connected by an urging action of said urging member.

6. An apparatus according to claim 4, wherein said recording head comprises an electrothermal transducer for generating thermal energy.

7. A carriage for supporting a head member for ejecting ink, said carriage comprising:

a carrying portion for carrying a head member and an ink container which are separably connectable with each other, wherein the head member has an ink ejection outlet for ejecting ink and an ink receptor portion for receiving a supply of the ink, and the ink container has a connecting portion and an ink supply portion for supplying the ink to the head member, when the head member and the ink container are connected, the ink receptor portion and the ink supply portion are connected for ink communication;

a supporting member for supporting the head member and the ink container, said supporting member having an abutment portion for being abutted by the head member;

an urging member, provided in said supporting member, for urging an end of the ink container to mount the head member and the ink container on said supporting member; and a pivot portion, provided in said supporting member, about which the ink container is rotated to the head member by said urging member, with the connecting portion of said ink container being substantially between said pivot portion and said urging member.

8. An apparatus according to claim 7, wherein the recording head and said carrying portion are electrically connected by urging action of said urging member.

9. An apparatus according to claim 7, wherein the recording head comprises an electrothermal transducer for generating thermal energy.

* * * * *

UNITED STATES PATENT AND TRADEMARK OFFICE

CERTIFICATE OF CORRECTION

PATENT NO. : 5,448,274 Page 1 of 3

DATED : September 5, 1995

INVENTOR(S) : Hiromitsu HIRABAYASHI, et al.

It is certified that error appears in the above-indentified patent and that said Letters Patent is hereby corrected as shown below:

ON THE TITLE PAGE:

AT [22] Filed:

"January 15, 1995" should read --January 13, 1995--.

AT [56] - REFERENCES CITED - FOREIGN PATENT DOCUMENTS:

"2039945 2/1990 Japan" should read --2-39945 2/1990 Japan--.

COLUMN 1:

Line 58, "a yet" should read --yet a--.

COLUMN 2:

Line 54, "recording-head" should read --recording head--.

COLUMN 5:

Line 22, "the-carriage" should read --the carriage--.

UNITED STATES PATENT AND TRADEMARK OFFICE

CERTIFICATE OF CORRECTION

PATENT NO. : 5,448,274 Page 2 of 3

DATED : September 5, 1995

INVENTOR(S) : Hiromitsu HIRABAYASHI, et al.

It is certified that error appears in the above-indentified patent and that said Letters Patent is hereby corrected as shown below:

COLUMN 6:

Line 13, "head." should read --head--.

COLUMN 7:

Line 25, "L" should be deleted.

COLUMN 9:

Line 38, "taking" should read --taken--;
Line 43, "carriage HC." should read --carriage HC is provided.--.

COLUMN 15:

Line 44, "wave" should read --waves--;
Line 64, "effects," should read --effects--.

COLUMN 16:

Line 13, "Of" should read --of--;
Line 25, "is the" should read --is applied. The--.

UNITED STATES PATENT AND TRADEMARK OFFICE

CERTIFICATE OF CORRECTION

PATENT NO. : 5,448,274 Page 3 of 3

DATED : September 5, 1995

INVENTOR(S) : Hiromitsu HIRABAYASHI, et al.

It is certified that error appears in the above-indentified patent and that said Letters Patent is hereby corrected as shown below:

COLUMN 18:

Line 38, "recording head" should read --head member--;
Line 39, "by" should read --by an--;
Line 42, "recording head" should read --head member--.

Signed and Sealed this

First Day of October, 1996

Bruce Lehman

*Attest:*

BRUCE LEHMAN

*Attesting Officer*

*Commissioner of Patents and Trademarks*